US005323979A

United States Patent [19]

Grecksch et al.

[11] Patent Number: 5,323,979

[45] Date of Patent: Jun. 28, 1994

[54] METHOD FOR OPERATING AN AUTOMATIC BOBBIN WINDING MACHINE

[75] Inventors: Hans Grecksch; Ulrich Wirtz, both of Monchen-Gladbach, Fed. Rep. of Germany

[73] Assignee: W. Schlafhorst AG & Co., Moenchengladbach, Fed. Rep. of Germany

[21] Appl. No.: 949,464

[22] Filed: Sep. 22, 1992

[30] Foreign Application Priority Data

Sep. 23, 1991 [DE] Fed. Rep. of Germany ..... 4131608

[51] Int. Cl.[5] ..... B65H 67/02; B65H 67/06

[52] U.S. Cl. ..... 242/35.5 A

[58] Field of Search ..... 242/35.5 A, 35.5 R, 242/18 R

[56] References Cited

U.S. PATENT DOCUMENTS

| | | | |
|---|---|---|---|
| 4,544,107 | 10/1985 | Matsui et al. | 242/35.5 A |
| 5,056,725 | 10/1991 | Wirtz et al. | 242/35.5 A |
| 5,078,329 | 1/1992 | Grecksch et al. | 242/35.5 A |
| 5,092,531 | 3/1992 | Grecksch et al. | 242/35.5 A |
| 5,190,136 | 3/1993 | Grecksch et al. | 242/35.5 A |

*Primary Examiner*—Stanley N. Gilreath

*Attorney, Agent, or Firm*—Shefte, Pinckney & Sawyer

[57] ABSTRACT

The invention relates to a method for operating an automatic bobbin winding machine, having a cop and tube transport system with a plurality of transport loops, which method makes the transport system usable for batch changing as well. According to the invention, when a batch of cops from a spinning machine runs out, i.e. when no further new cops are being delivered to the winding machine, the unwound tubes are carried in circulation in the transport system of the winding machine.

4 Claims, 1 Drawing Sheet

METHOD FOR OPERATING AN AUTOMATIC BOBBIN WINDING MACHINE

FIELD OF THE INVENTION

The present invention relates to a method for operating an automatic bobbin winding machine.

BACKGROUND OF THE INVENTION

Automatic bobbin winders often have an associated cop and tube transport system that may have a plurality of transport loops for cops and tubes. Such transport systems in many cases also have a direct connection with the transport system of an associated spinning machine, with yarn-wound cops and empty tubes being exchanged at the intersection between the transport systems. One such transport system is known from German Patent Document 39 19 542 A1, for example. However, such German reference does not disclose how to proceed upon a batch change.

SUMMARY OF THE INVENTION

It is accordingly an object of the present invention to provide a method for operating an automatic bobbin winding machine that can be employed upon batch changing.

Briefly described, the present method contemplates that, in a combined textile spinning and winding machine system, when a batch of cops runs out, the cops which have been delivered to the winder should be used up, i.e. unwound, but the unwound tubes which result should not be delivered back to the spinning machine. Thus, the emptied tubes belonging to that batch must be stored. According to the present invention, storage is accomplished by causing the unwound tubes to circulate within the winder's transport system, thereby allowing storage of the tubes without requiring additional storage capacity.

In normal operation of a combined spinning and winding machine system, empty tubes which have been unwound by the winder are to be replaced by full cops by transferral between a transport path of the spinning machine and an adjacent transport path of the bobbin winder. However, this process is completed whenever no further full cops arrive from the spinning machine after the batch has run out. The transport path of the winder at which cop transferral takes place should thereafter not be supplied with any further empty tubes. This can be accomplished in a simple manner by diverting the empty tubes upstream of the transport path of the winder intended for the exchanging and returning the tubes to the corresponding cop delivery path of the spinning machine.

In order not to bring about unnecessary exchange operations at the winding stations as a result of the empty tubes remaining in the transport system of the winder, it is advantageous to detect the empty tubes with sensors at transport branches leading to the winding stations and shunt the empty tubes past these branches. The tubes then pass around the end of the winding machine to reach its tube return path, into which the transport paths extending through the winding stations discharge. One such path extending around the end of the winding machine is described for example in German Patent Document DE 39 19 542 A1 describing such a basic apparatus.

It is also advantageous to transport the cops and tubes while mounted vertically on the mounting mandrels of caddies that rest on conveyor belts, by which they are carried along by friction. Such caddies may be guided within transport channels. Transport systems of this kind have been known for some time, for example from Japanese Laid Open Patent Application 52-25,139.

DESCRIPTION OF THE PREFERRED EMBODIMENT

Figure 1A:
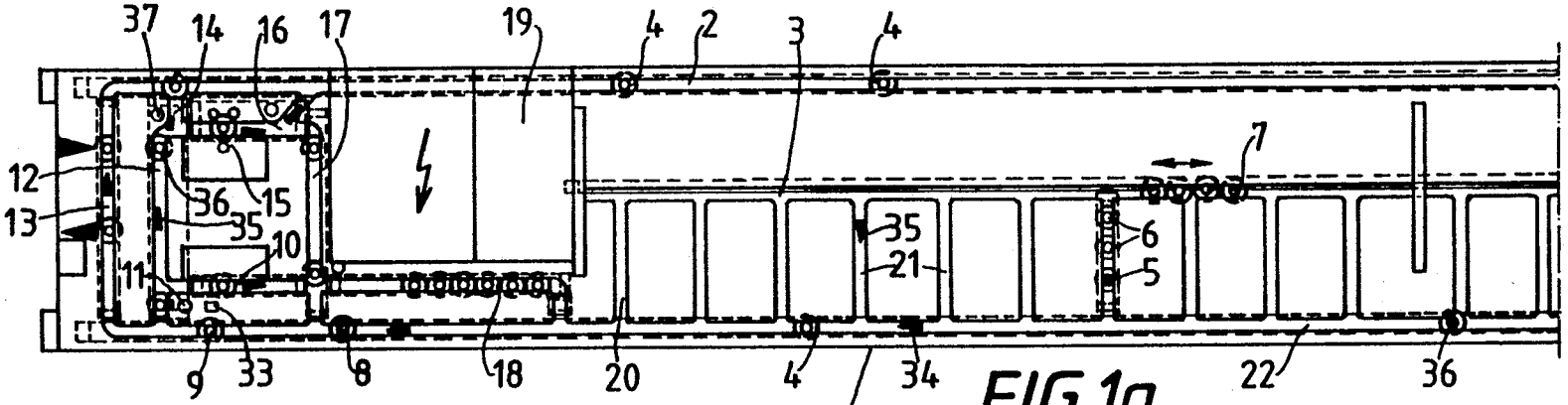
FIG. 1*a* is a schematic plan view of the left end of a bobbin winding machine having a bobbin transport system.
Figure 1B:
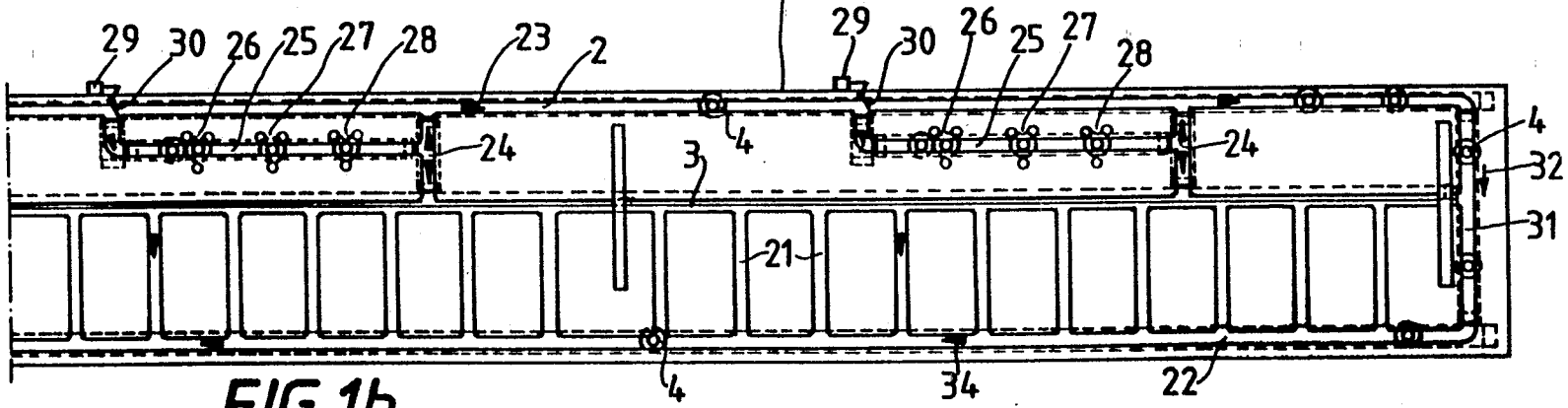
FIG. 1*b* is a schematic plan view of the right end of a bobbin winding machine having a bobbin transport system.

Referring now to the accompanying drawings, the bobbin winding machine I has a system of conveyor belts defining transport paths for yarn cops and tubes including a plurality of transport loops, some of which have shared transport paths. Caddies 4 that carry yarn-wound cops or empty tubes are transported along these transport paths. The cops and tubes have not been shown, for the sake of simplicity.

The transport path system includes a delivery track 2 extending along the entire bobbin winder 1 for delivering caddy-supported cops to the multiple winding stations of the winder 1. Preparation segments 25 of the transport system, each of which extends through a series of preparation stations 26,27,28, branch from the delivery track 2. Preparation of the cops in stages for subsequent yarn unwinding operation can be done in a known manner, as described in German Patent Document DE-39 19 542 A1, for example, by these preparation stations 26,27,28. The transport system further includes a distributing segment 24 provided at the end of each preparation segment 25, which delivers the caddy-mounted cops alternatively to either a reversing conveyor belt 3 extending lengthwise alongside the winding stations or back to the delivery track 2. This distributor segment 24 is actuated by the last preparation station 28, which monitors the success of cop preparation. If the cop was successfully prepared, then the distributor segment 24, which may also comprise a reversing conveyor belt, transports the cop and its supporting caddy onto the reversing conveyor belt 3. However, if it was not possible to prepare the cop successfully, then the caddy 4 carrying the cop is directed to the delivery track 2, which either carries it to the next preparation segment 25 or guides it around the end of the bobbin winder 1 via the connecting path 31 to the return belt 22. This return belt 22 extends along the entire bobbin winder parallel to the delivery belt 2 at the opposite side of the winder. The distribution of the cops to the various preparation segments 25 is also described in German Patent Document DE 39 19 542 A1 and thus need not be described in further detail here.

The traveling direction of the belt 3 is reversed at predetermined time intervals to distribute the caddies carrying prepared cops to the individual transport tracks 21 leading through the winding stations 5. Between the cop unwinding position of each winding station 5 and the reversing belt 3, each transport track 21 provides two reserve positions 6 for caddies 4 carrying cops. Groups of cop-mounted caddies, collectively indicated at 7 travel back and forth along the reversing belt 3, with individual caddies entering a transport track 21 leading through a winding station whenever its rearmost reserve position 6 is not occupied. Details on this operation can again be found in German Patent Document DE 39 19 542 A1. For the sake of simplicity, the drawings show only a small proportion of the cop-mounted caddies 4 which would travel along the transport system in actual practice. Specifically, in most cases each transport track 21 would normally be occupied by three caddies, which is shown in the drawings for only one transport track 21.

The transport tracks at the end of the return belt 22 will now be described in further detail, along with the associated processing stations. A so-called remnant cop, i.e. one which still has a sufficient quantity of remnant yarn for further processing, is indicated at 9. This remnant cop 9 is shown to be traveling next to a remnant yarn detector 33, which detects the quantity of yarn still present on the cop tube. This remnant yarn detector 33 controls an electromagnet 11, which acts upon an iron ring which surrounds the base plate of each of the caddies 4 and shunts the caddy supporting the remnant cop 9 from the return belt 22 onto a secondary transport track 12. This secondary transport track 12 delivers the remnant cop 9 to a yarn end preparation device 15, which operates to find the end of the remnant yarn on the upper conical portion of the cop tube, regardless of its position, and then places the yarn end in such a way that it can be grasped at the winding station. By means of a connection segment 16, a thusly-prepared remnant cop is then returned to the delivery track 2. The yarn end preparation device 15 likewise has a detector which monitors the success of yarn end preparation on remnant cops so that if the yarn end on the remnant cop 9 could not be prepared successfully, the cop and its caddy are directed along a delivery path 17 to a storage segment 18.

The remnant yarn detector 33 is also operative to identify tubes having only a small remnant yarn quantity, as represented by the tube 8 shown moving past an end frame 19 of the winder, and to divert such tubes and their caddies by the electromagnet 11 to the secondary transport track 12. However, immediately after such diversion occurs, the tube 8 is diverted once again to a tube cleaner 10. Another electromagnet (not shown for reasons of clarity) may also be disposed at this branching point and actuated by the remnant yarn detector 33. The cleaned tube 8 and its caddy 4 then return to the return path 22 or, if tube cleaning was not successful, the tube and caddy travel to the storage segment 18 (reference may also be made on this point to German Patent Document DE 39 19 542 A1).

A tube 36 that has been fully unwound until empty and has been ejected from a winding station 5 is likewise delivered with its supporting caddy over the return track 22 to the remnant yarn detector 33, which in normal operation does not switch on the electromagnet 11, so that the caddy carrying the empty tube 36 reaches the transport track 13, on which the empty tube is exchanged for a full yarn-wound cop arriving from the spinning machine. This cop together with a supporting caddy then travels to the delivery track 2 and proceeds as above-described to an unwinding position of one winding station in the bobbin winder.

When a batch of yarn-wound cops has been exhausted and no further exchange between empty tubes and fully wound cops is being carried out on the transport track 13, then it is advantageous to stop the transport track 13 and to divert the empty tubes 36 to the transport track 12 by means of the shunt formed by the electromagnet 11. The control to the remnant yarn detector 33 is then switched to maintain the electromagnet energized continuously. In addition, after each empty tube 36 has moved past the detector 33, it activates another electromagnet 37, causing the empty tube 36 to be returned over the transport path 14 for empty tubes to the delivery track 2 instead of being directed to the preparation device 15. Regardless of this, remnant cops 9 detected by the remnant yarn detector 33 can still be directed to the yarn end preparation device 15, by the selective nonactivation of the electromagnet 37 by the remnant yarn detector 33 after it has identified a remnant cop. Tubes with small quantities of remnant yarn may also be delivered to the yarn cleaner 10 in the manner described. Thus all the necessary functions of these devices occur even if the empty tubes 36 are circulating in the transport system.

At the various branching points from the delivery track 2 to the preparation segments 25, sensors 29 are provided, which recognize arriving empty tubes 36 and open an adjacent shunt 30, to cause each caddy 4 carrying an empty tube 36 to continue traveling on the delivery track 2, which assures that the empty tubes will remain on the transport paths intended for them. Regardless of this operation, the shunts 30 also serve to distribute the cops among the differing preparation segments 25 during normal operation of the bobbin winder. For example, and as shown in the drawing, if two preparation segments 25 are provided, then the shunt 30 disposed at the first branching point in the delivery direction of the cops along the delivery track 2 would allow every other cop to pass the first preparation segment in alternation. It is naturally equally possible to switch the shunt 30 after every two or more cops. If the preparation segment 25 between the delivery track 2 and the first preparation station 26 is filled, then the next arriving cop and its caddy 4 are automatically shunted by the outer edge of the last caddy on the segment 25 so as to continue transport over the delivery track 2 to the next preparation segment 25.

The paths of the empty tubes are shown in the form of directional arrows 23,32,34 and 35. Notably, the transport system is long enough to receive all the empty tubes 36, because the number of caddies 4 in the transport system remains constant. In this way, a additional storage place for temporarily storing the empty tubes 36 until conclusion of the batch change is unnecessary.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for operating an automatic bobbin winding machine wherein cops comprising tubes wound with yarn are unwound at plural winding stations and cops and unwound tubes travel along a transport system having plurality of transport loops including transport paths shared by some of the transport loops, the method comprising the step of, when a batch of multiple cops has been unwound and replacement cops have not been delivered to the bobbin winding machine, causing the unwound tubes of the batch to circulate in the transport system of the winding machine.

2. The method of claim 1, wherein the transport system includes a main delivery path extending along the length of the winding machine and an exchange transport path along which empty tubes may be replaced with full cops, and further comprising the step of diverting unwound tubes at a location upstream of the exchange transport path and directing the diverted tubes to the main delivery path.

3. The method of claim 1, wherein the transport system includes secondary delivery paths for directing cops to the winding stations and a return path for receiving unwound tubes from the winding stations, the method further comprising the steps of detecting unwound tubes traveling along the transport system and directing the detected unwound tubes past the secondary delivery paths for the winding stations and onto the return path.

4. The method of claim 1, and further comprising the steps of supporting the cops and unwound tubes during transportation in an upright disposition on caddies having mounting mandrels for insertion into the cops and tubes, and transporting the caddies by conveyor belts.

* * * * *